US011129767B1

(12) United States Patent
Haddock DiCarlo et al.

(10) Patent No.: US 11,129,767 B1
(45) Date of Patent: Sep. 28, 2021

(54) MASSAGER

(71) Applicant: Uccellini LLC, Bend, OR (US)

(72) Inventors: Lora LeeAnne Haddock DiCarlo, Bend, OR (US); Blake Michael Larkin, Eugene, OR (US); Ada-Rhodes Short, Corvallis, OR (US); Avery Dawn Smith, Albany, OR (US); Mazie Houchens, Corvallis, OR (US); Kim Porter Henneman, Bend, OR (US)

(73) Assignee: UCCELLINI LLC, Bend, OR (US)

( * ) Notice: Subject to any disclaimer, the term of this patent is extended or adjusted under 35 U.S.C. 154(b) by 0 days.

(21) Appl. No.: 16/934,275

(22) Filed: Jul. 21, 2020

(51) Int. Cl.
*A61H 19/00* (2006.01)
*A61H 15/00* (2006.01)

(52) U.S. Cl.
CPC ..... *A61H 19/34* (2013.01); *A61H 15/0085* (2013.01); *A61H 2015/0042* (2013.01); *A61H 2015/0071* (2013.01); *A61H 2201/169* (2013.01)

(58) Field of Classification Search
CPC ..... A61H 19/00; A61H 19/30; A61H 19/32; A61H 19/40; A61H 19/44; A61H 19/50; A61H 7/00; A61H 7/007; A61H 7/002; A61H 7/003; A61H 7/004; A61H 7/005; A61H 7/006; A61H 2007/009; A61H 15/00; A61H 15/0078; A61H 15/002; A61H 15/0085; A61H 2015/0007; A61H 2015/0014; A61H 2015/0028; A61H 2015/0035; A61H 2015/0057; A61H 21/00; A61H 2201/1635; A61H 2201/169;
(Continued)

(56) References Cited

U.S. PATENT DOCUMENTS 6,165,145 A * 12/2000 Noble ..... A61H 23/0254 601/103
2005/0049528 A1* 3/2005 Lagercrantz ..... A61H 7/005 601/87
2007/0142754 A1 6/2007 Nan
(Continued)

OTHER PUBLICATIONS

Merriam-Webster, Definition of "shim", Accessed Sep. 24, 2020. (Year: 2020).*

(Continued)

*Primary Examiner* — Valerie L Woodward
*Assistant Examiner* — Paige Kathleen Bugg
(74) *Attorney, Agent, or Firm* — Maxine Lynn Barasch; Keohane & D'Alessandro, PLLC

(57) ABSTRACT

Disclosed embodiments provide an improved massager for clitoral massage and stimulation. The massager in accordance with disclosed embodiments is configured and disposed to move one or more balls along an interior wall of a cavity of an housing of the massager. A membrane is disposed over at least a portion of the housing, including the cavity. Multiple ribs are formed in a contact area of the membrane. The contact area is the area of the membrane intended to be placed against the clitoris of a user during use. In embodiments, the ribs are raised such that they protrude outward from the membrane. The ribs may be arranged in a radial pattern around a center portion of the contact area, which also aligns with a center point of rotation of the balls, in order to create an enhanced user experience.

20 Claims, 24 Drawing Sheets

(58) Field of Classification Search
CPC .... A61H 2201/1657; A61H 2201/5007; A61H 2201/5038; A61H 2201/5097
See application file for complete search history.

(56) References Cited

U.S. PATENT DOCUMENTS

| | | | | |
|---|---|---|---|---|
| 2010/0268021 | A1* | 10/2010 | Standfest | A61H 19/44 600/38 |
| 2016/0256348 | A1* | 9/2016 | Giraud | A61H 15/0085 |
| 2019/0191937 | A1* | 6/2019 | Straka | A61H 7/004 |

OTHER PUBLICATIONS

Encyclopedia Britannica, Definition of "control unit", Accessed Sep. 24, 2020. (Year: 2020).*
Lynn, Regina, "'Sensual Intelligence' Gives New Sadi Sex Toy an Erotic Edge", Wired, https://www.wired.com/2008/01/sexdrive-0118/, Jan. 18, 2008, 12 pgs.
Eaton, Kit, "New Sasi Sex Toy Gets Intelligent With Your Nether Regions", Gizmodo, https://gizmodo.com/new-sasi-sex-toy-gets-intelligent-with-your-nether-regi-346406, Jan. 18, 2008, 4 pgs.
Sloan, Kate, "Review: JeJoue Sasi", Girlyjuice, https://girlyjuice.net/review-jejoue-sasi/, Mar. 11, 2013, 2 pgs.
Sutra, Cara, Je Joue Sasi Review (& LELO ORA Oral Sex Simulator Comparison), Carasutra, https://carasutra.com/review/je-joue-sasi-review-lelo-ora-oral-sex-simulator-comparison/, Feb. 24, 2014, 6 pgs.
Alptraum, Lux, "The Vibrator of the Future Won't Vibrate", Motherboard Tech by Vice, https://www.vice.com/en_us/article/qkjz8x/the-vibrator-of-the-future-wont-vibrate, Jul. 14, 2016, 6 pgs.
"Je Joue SaSi Vibrator, Plum", Amazon, https://camelcamelcamel.com/Je-Joue-SaSi-Vibrator-Plum/product/B002T5LKMQ, 2010, 5 pgs.
"Je Joue Sasi, Tongue Massager", AliExpress, https://www.aliexpress.com/item/552706705.html, 2008, 5 pgs.
"SASI Product", 2008, 5 pgs.
Thomas, Sophie Saint, "My Honest Review of Lelo's Ora 2, a High-Tech Sex Toy That Simulates Oral Sex", https://www.allure.com/story/lelo-ora-2-oral-sex-simulator-review, Aug. 24, 2018, 3 pgs.
Thomas, Sophie Saint, "My Honest Review of Lelo's Ora 2, a High-Tech Sex Toy That Simulates Oral Sex", https://www.allure.com/story/lelo-ora-2-oral-sex-simulator-review, Aug. 24, 2018, Screenshots of Video Clip, 2 pgs.
amazon.com, "Lelo Ora 3 Oral Pleasure Massager Sensual Personal Stimulator for Women", https://www.amazon.com/LELO-Pleasure-Massager-Personal-Stimulator/dp/B081QWWPYK/ref=sr_1_1?dchild=1&keywords=lelo+ora+3&qid=1602005745&s=hpc&sr=1-1, Nov. 20, 2019, 6 pages.
youtube.com, "Lelo Ora Luxury10 Function Rotating Clitoral Vibrator", https://www.youtube.com/watch?v=U6ZLaTg8ZOU, Apr. 28, 2016, 1 pg.
EP Application No. 19817570.5-1126, Search Report, dated Sep. 23, 2020, 15 pgs.

* cited by examiner

MASSAGER

FIELD

Disclosed embodiments relate to a personal massager.

BACKGROUND

Stimulation of skin or body has many beneficial effects, including raising blood flow in the area, and stimulating nerve endings. Massage is a process of moving skin and tissue in such a way to stimulate blood flow, loosen muscles, and provide other beneficial effects. In addition, on a human body, a vulva includes organs including a clitoris, mons pubis, labia majora, and labia minora surrounding the vagina. The glans clitoris is a portion of the clitoris that is on the vulva, external to the vagina. The glans clitoris has thousands of nerve endings, and the vulva is sexually responsive. Stimulation of a person's glans clitoris increases blood flow to the area and provides sexual pleasure. There exists a need for improvements in personal massagers that can provide increased massage or stimulation.

SUMMARY

In one embodiment, there is provided a massager, comprising: a housing having a cavity therein; a motor disposed within the housing; a membrane disposed over at least a portion of the housing, including the cavity; and a paddle mechanically coupled to the motor, such that as the motor operates, the paddle moves at least one ball along an interior wall of the cavity of the housing.

In another embodiment, there is provided a massager, comprising: a housing having a cavity therein; a drive unit disposed within the housing; a paddle and at least one ball disposed in an interior of the cavity; a membrane disposed over at least a portion of the housing, including the cavity; and a processor; and a memory, wherein the memory contains instructions, that when executed by the processor, causes the drive unit to move the paddle.

In yet another embodiment, there is provided a massager, comprising: an housing having a cavity therein; a motor disposed within the housing; a membrane disposed over at least a portion of the housing, including the cavity; and a paddle mechanically coupled to the motor, such that as the motor operates, the paddle rotates and moves at least one ball along an interior wall of the cavity of the housing; a processor; and a memory, wherein the memory contains instructions, that when executed by the processor, cause the motor to perform an operation sequence, wherein the operation sequence comprises rotating at a first speed for a first duration, followed by rotating at a second speed for a second duration.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

13A shows a side cutaway view of details of an additional embodiment.

Figure 13B:
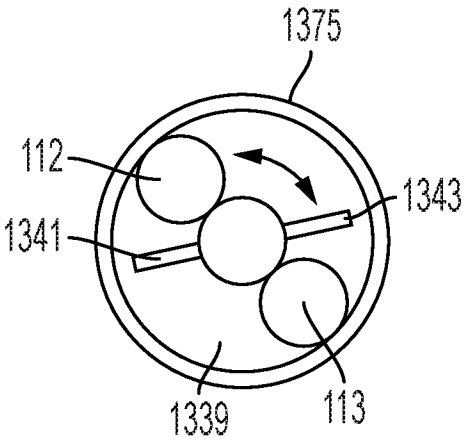
Figure 13A:
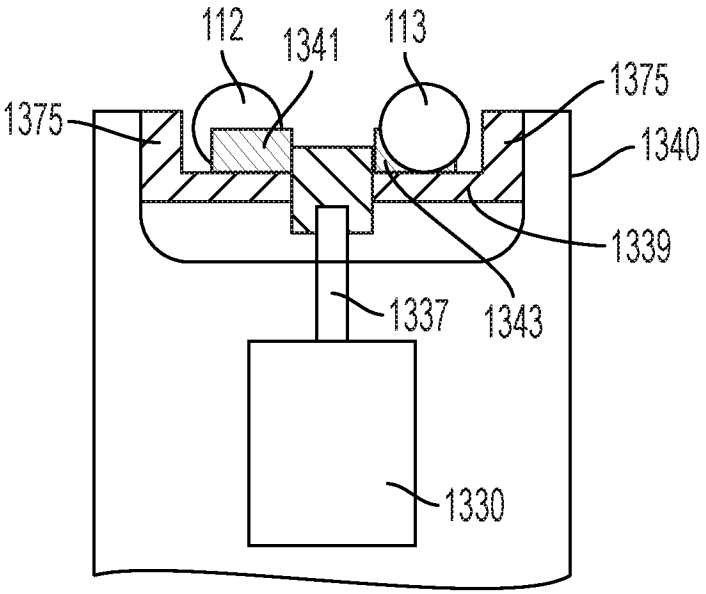

FIG. 13B shows a top-down view of FIG. 13A.

Figure 14B:
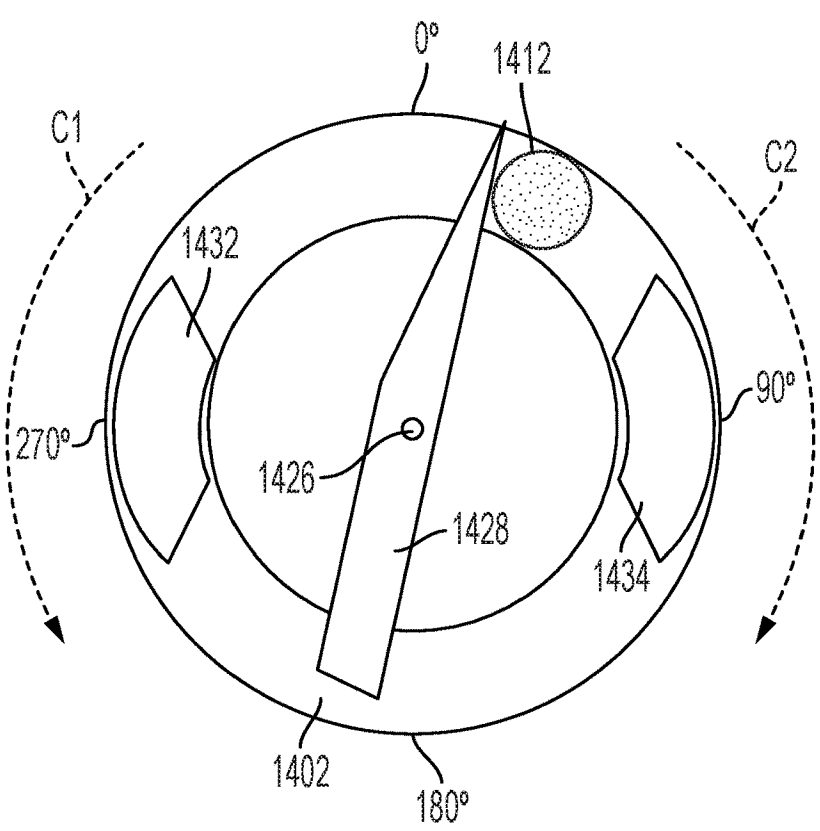
Figure 14A:
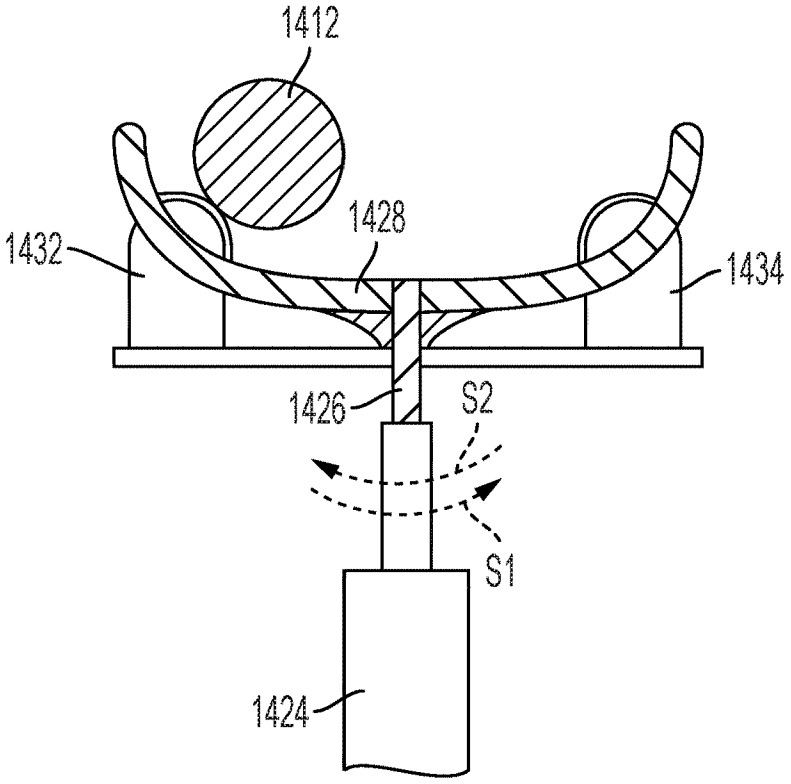

FIG. 14A shows a side cutaway view of an additional embodiment using shims.

FIG. 14B shows a top-down view of an additional embodiment using shims.

Figure 14C:
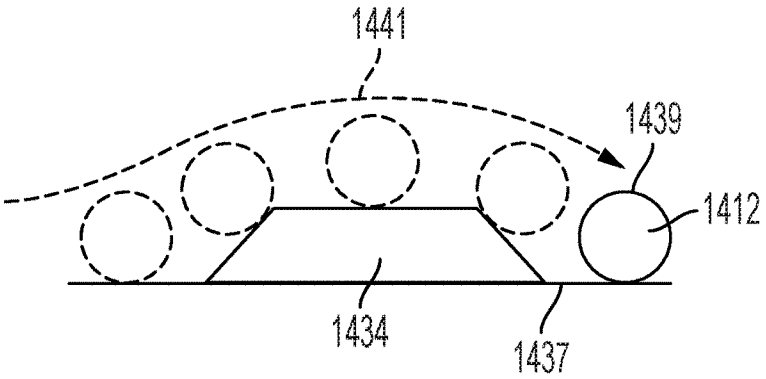

FIG. 14C shows a side view indicating detail of a shim and ball travel.

Figure 15:
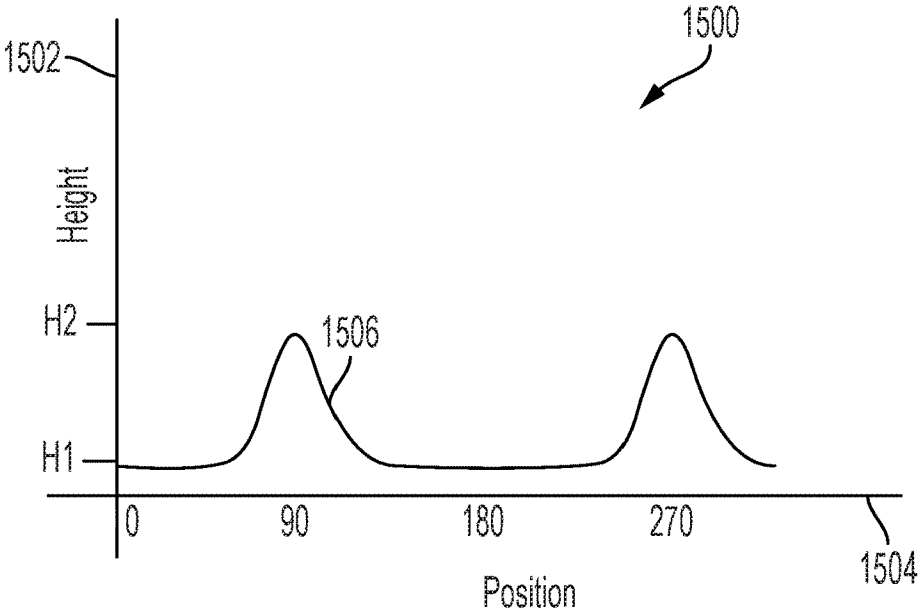

FIG. 15 is a graph showing the relationship of the height of the top of a ball above the base level of the track.

Figure 16B:
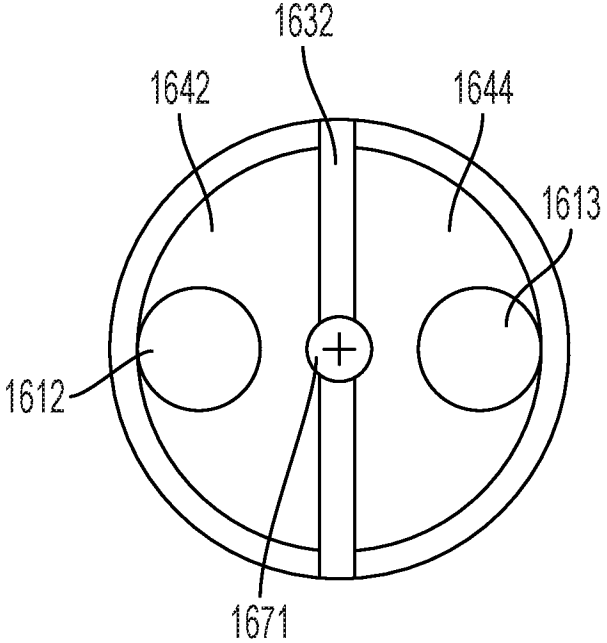
Figure 16A:
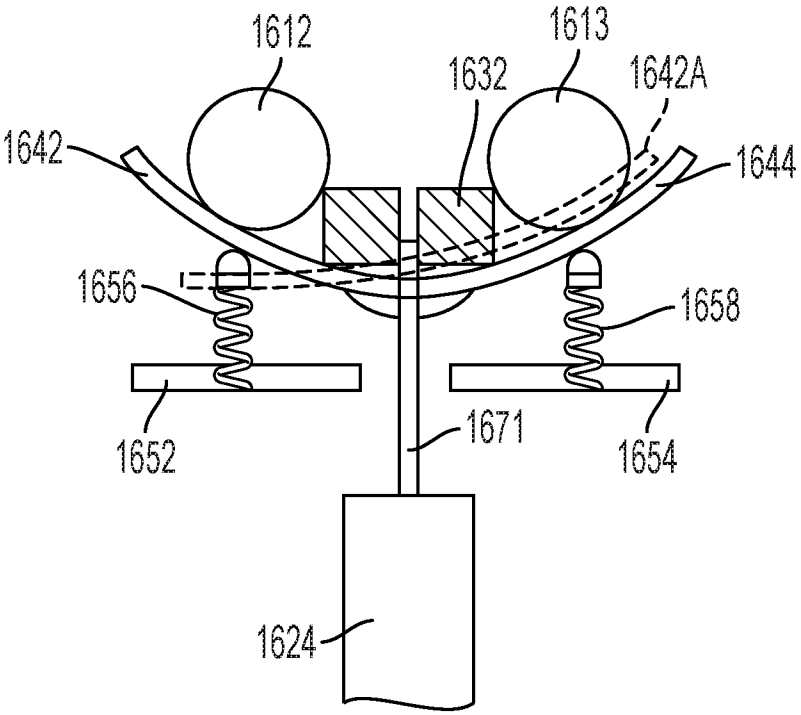

FIG. 16A shows a side cutaway view of an additional embodiment utilizing a split carrier.

FIG. 16B shows a top-down view of an additional embodiment utilizing a split carrier.

DETAILED DESCRIPTION

Disclosed embodiments provide an improved massager (referred to interchangeably here with "massager") for massage and stimulation. The massager in accordance with disclosed embodiments is configured and disposed to move one or more balls along an interior wall of a cavity of an housing of the massager. A membrane is disposed over at least a portion of the housing, including the cavity. In embodiments, multiple ribs are formed in a contact area of the membrane. The contact area is the area of the membrane intended to be placed against the clitoris, or other body part, of a user during use. In embodiments, the ribs are raised such that they protrude outward from the membrane. The ribs may be arranged in a radial pattern around a center portion of the contact area, which also aligns with a center point of rotation of the balls, in order to create an enhanced user experience. In some embodiments, the massager is a sex toy or sexual aid.

Reference throughout this specification to "one embodiment," "an embodiment," "some embodiments", or similar language means that a particular feature, structure, or characteristic described in connection with the embodiment is included in at least one embodiment of the present invention. Thus, appearances of the phrases "in one embodiment," "in an embodiment," "in some embodiments", and similar language throughout this specification may, but do not necessarily, all refer to the same embodiment.

Moreover, the described features, structures, or characteristics of the invention may be combined ("mixed and matched") in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, and/or elements. For the purposes of disclosure, the word, "substantially" is defined as "for the most part". It means "to a great extent," but having some room for some minor variation.

Figure 1A:
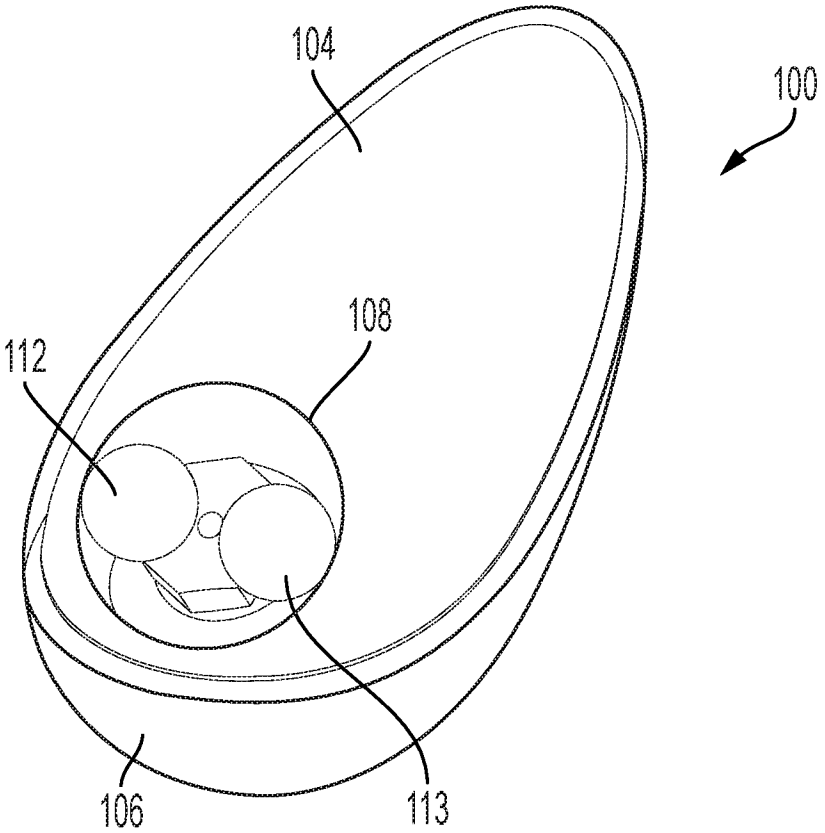
FIG. 1A is a perspective view of a massager in accordance with disclosed embodiments.
Figure 1B:
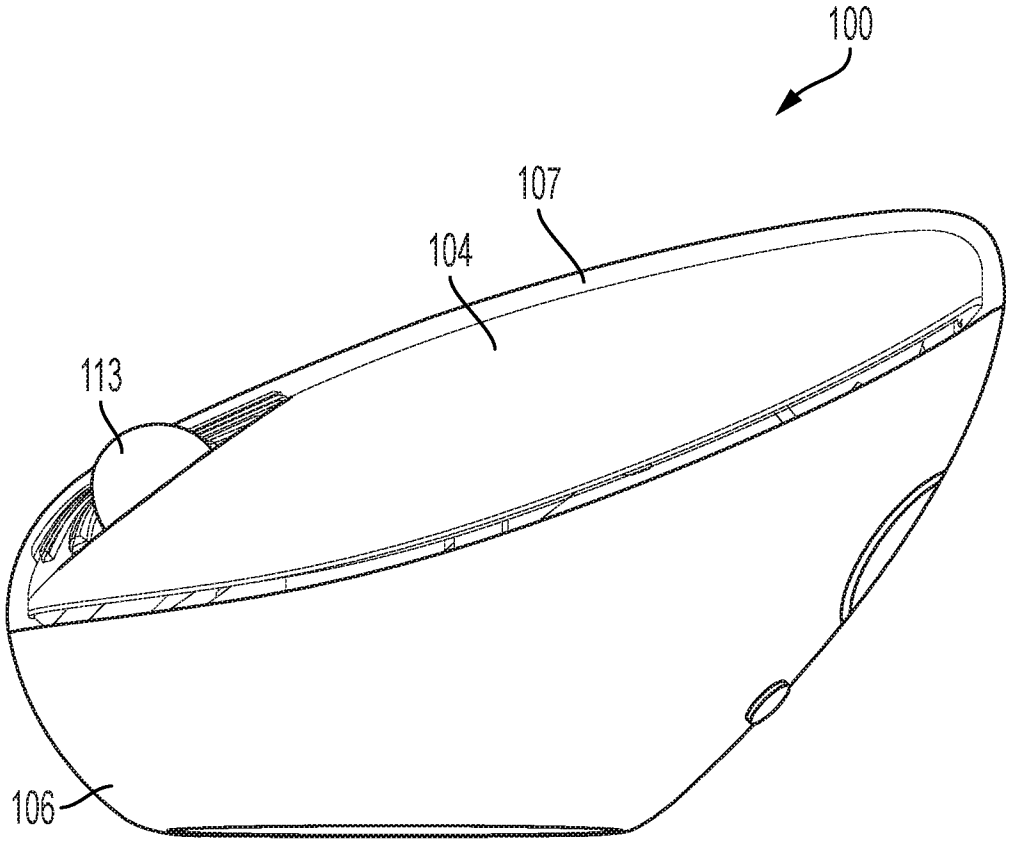
FIG. 1B is a side view of a massager in accordance with disclosed embodiments.
Figure 1C:
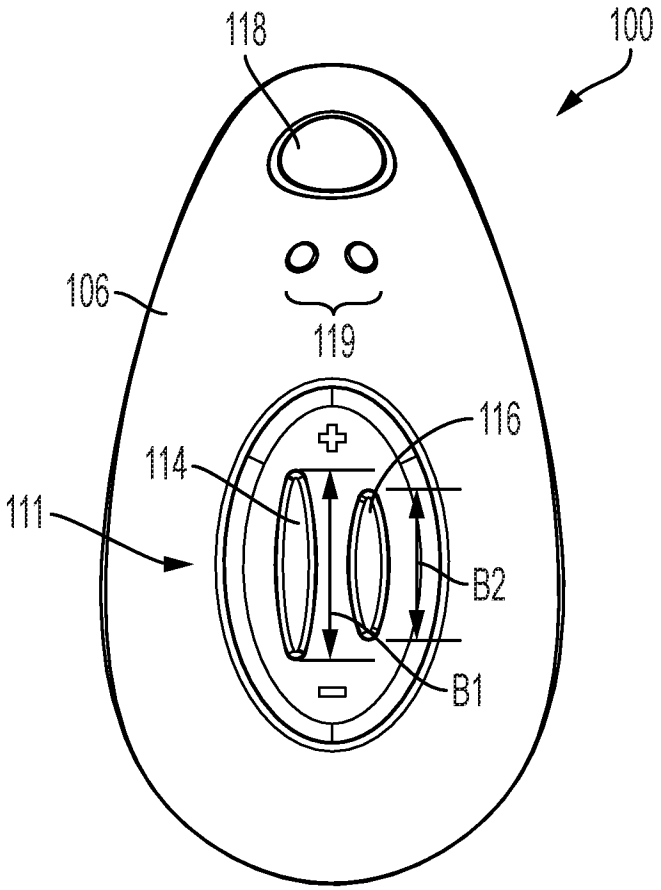
FIG. 1C is a bottom-up view of a massager in accordance with disclosed embodiments.
Figure 1D:
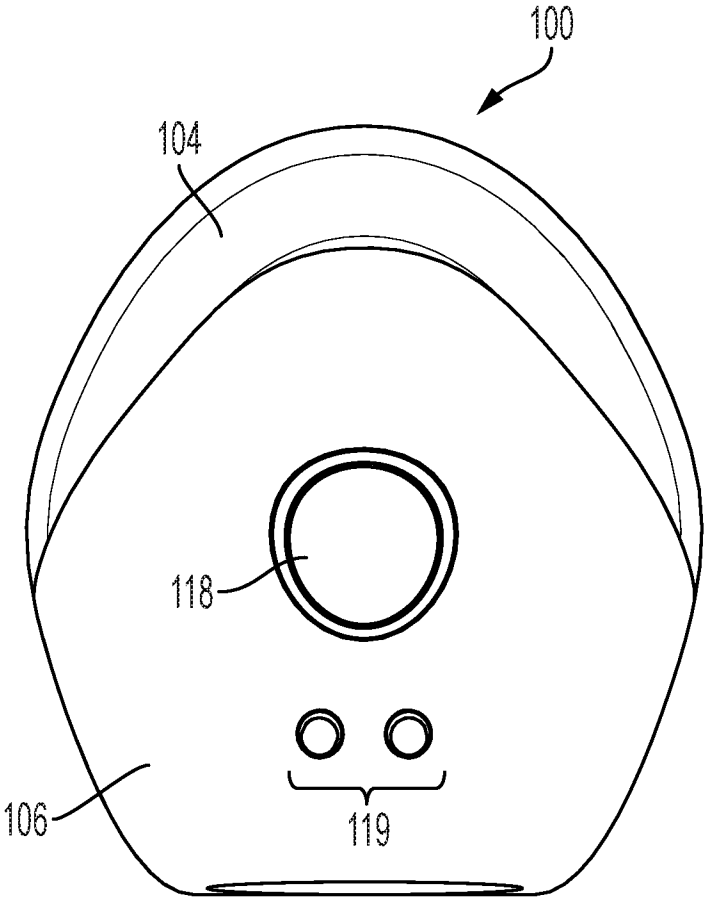
FIG. 1D is a back view of a massager in accordance with disclosed embodiments.

FIGS. 1A-1D show views of a massager 100 in accordance with disclosed embodiments. FIG. 1A is a perspective view. FIG. 1B is a side view with a portion of the membrane cut away such the ball is visible. FIG. 1C is a bottom-up view. FIG. 1D is a back view. Referring now to FIGS. 1A-1D, the massager 100 comprises first housing portion 104 and a second housing portion 106. This is not meant to be limiting, and in other embodiments, the housing can be made of more or fewer pieces. In the embodiment described herein, a membrane 107 is disposed over at least a portion of the first housing portion 104. In embodiments, the membrane 107 is comprised of silicone. In other embodiments, the membrane 107 is comprised of rubber, plastic, vinyl, or other suitable material. In embodiments, the at least one ball 113 protrudes out from the cavity wall (115 of FIG. 3) against the membrane 107.

At least one ball is disposed within a cavity 108 (an indented pathway) formed in the first housing portion 104. The cavity 108 forms a track for the at least one ball ("cavity" and "track" are used interchangeably herein). The cavity wall may be concave in shape to snugly hold the ball when the at least one ball is round, or other suitable shape when the at least one ball is another shape. In embodiments, the membrane 107 covers the cavity 108. The membrane is elastic, putting force on the balls to hold them within the cavity. "Elastic material" herein is a material that is expandable by force, but returns to its original size when the force is removed. The ball may be spherical, spheroid, oval-shaped, or other suitable shape. In the embodiment shown, the at least one ball comprises two balls 112 and 113. In operation, the balls 112 and 113 are moved in a circular path by a motor. This motion applies a pressure against a "contact area" of a membrane, which may include plurality of ribs. When the contact area, is placed against the body of a user, it can create a massage and/or pleasurable sensation for that user.

The massager 100 comprises a user interface 111 as indicated in FIG. 1C. The user interface 111 includes a speed control 114 and a pattern mode control 116. In embodiments, the speed control 114 comprises a button of a first size, and the pattern mode control 116 comprises a button of a second size, where the first size is different from the second size. In some embodiments, the buttons 114 and 116 are elongated, where button 114 has length B1, and button 116 has length B2. In embodiments, B1 is greater than B2. In some embodiments, B1 is 10 percent to 25 percent greater than B2. In this way, a user can operate the controls of the user interface using tactile sense. In other words, the user can operate the massager user interface 111 "by feel" rather than needing to have visual sight of the user interface 111. This user interface is an example, and any suitable user interface can be substituted within the scope of embodiments of the present invention.

In some embodiments, the charging port 119 may be an inductive charging port to enable wireless charging. In some embodiments, the charging port 119 may include a physical connection, such as a prong receptacle, USB-C connection, or other suitable connection for charging of an internal battery. In some embodiments, the device is powered on or off by pressing and holding button 118 for a predetermined duration (e.g., five seconds).

Figure 2A:
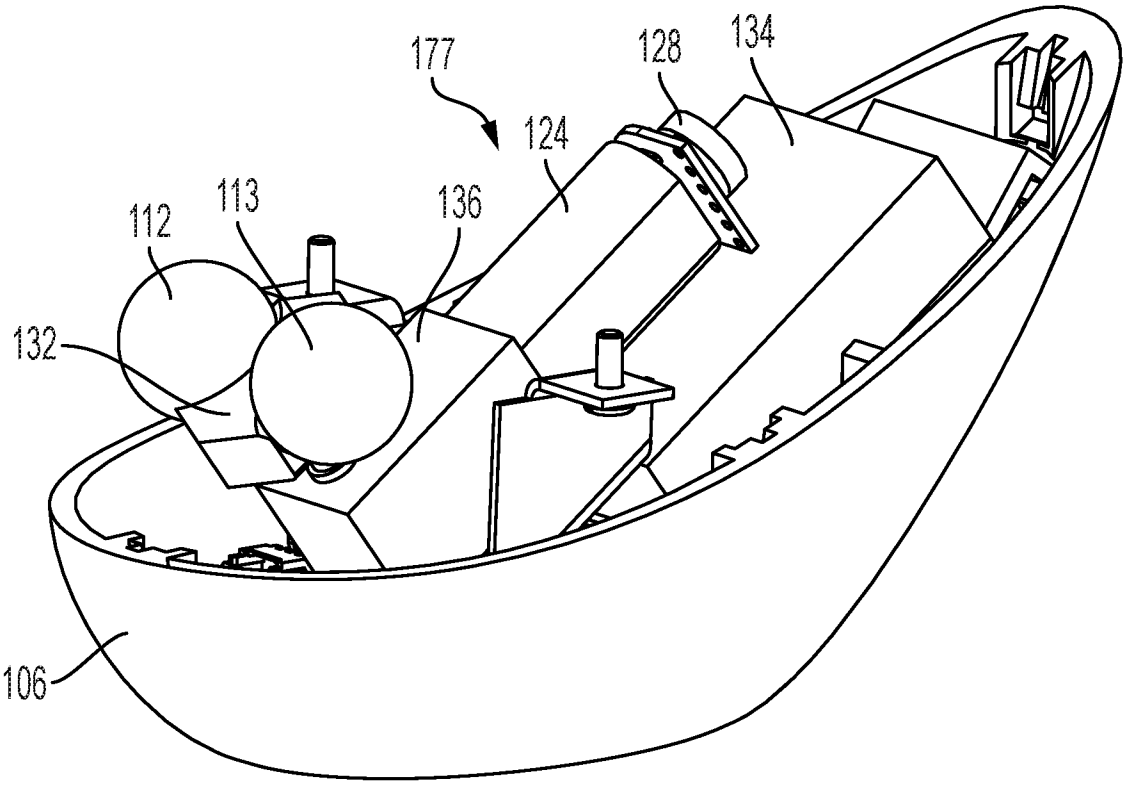
FIG. 2A is a perspective view of internal components of a massager in accordance with disclosed embodiments.
Figure 2B:
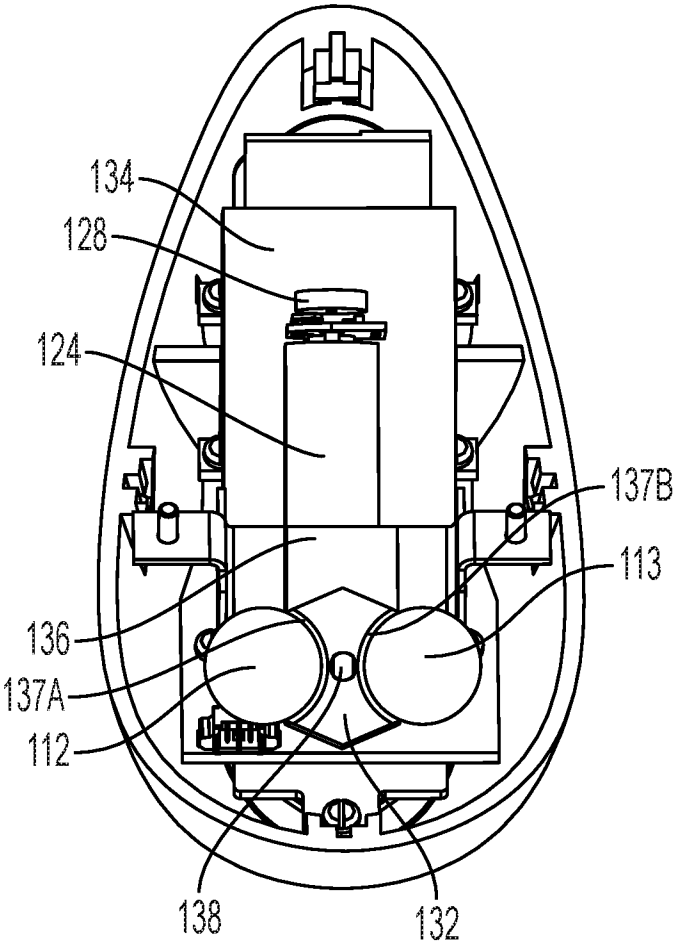
FIG. 2B is a top-down view of internal components of a massager in accordance with disclosed embodiments.
Figure 2C:
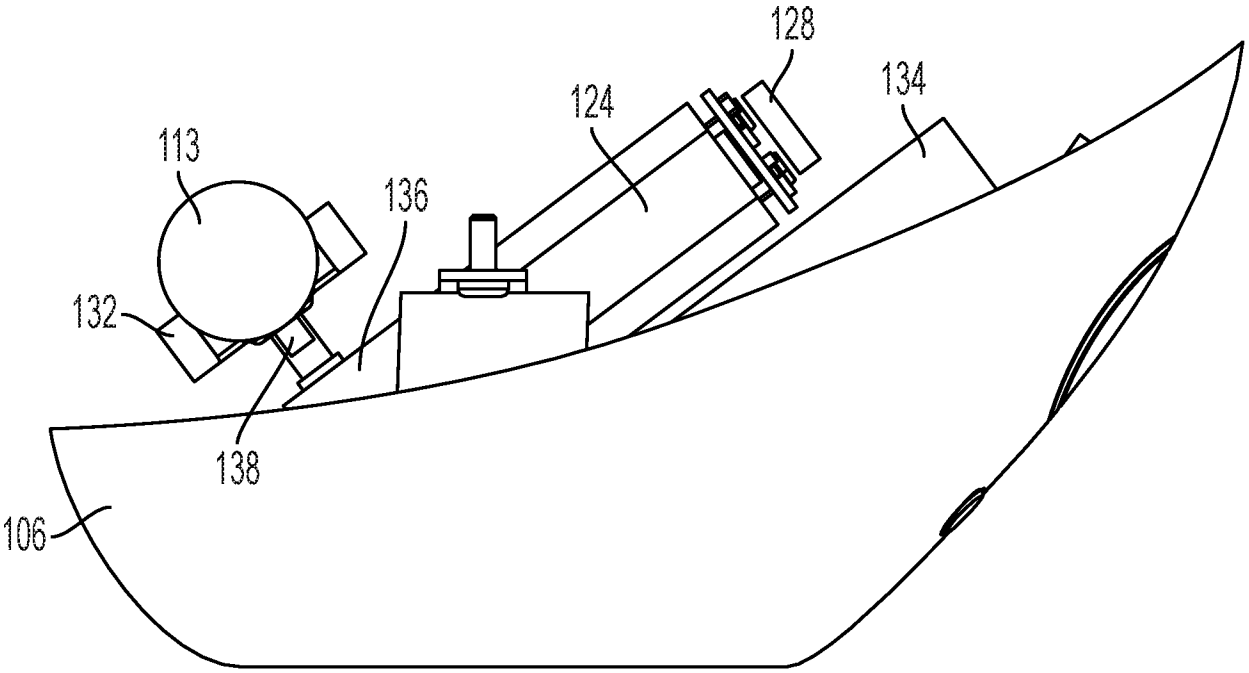
FIG. 2C is a side view of internal components of a massager in accordance with disclosed embodiments.

FIG. 2A is a perspective view showing internal components of a massager in accordance with disclosed embodiments. FIG. 2B is a top-down view showing internal components of a massager in accordance with disclosed embodiments. FIG. 2C is a side view showing internal components of a massager in accordance with disclosed embodiments.

Referring now to FIGS. 2A-2C, views are shown with the membrane 107 and first housing portion 104 removed in order to reveal internal components. An internal battery 134 is configured and disposed to power a motor 124. In embodiments, an encoder 128 is coupled to the motor to determine and track position, direction, and/or speed of the motor 124. Optionally, a transfer case 136 may include one or more gears configured and disposed to configure a power takeoff shaft 138 that rotates as the motor 124 operates. The power takeoff shaft 138 is affixed to a paddle 132. In embodiments, the paddle 132 comprises concave surfaces 137A and 137B to engage with balls 112 and 113, respectively. The concave surfaces 137A and 137B extend only partially laterally around balls 112 and 113, respectively. The encoder 128 may include an absolute encoder and/or an incremental encoder.

The encoder enables precise tracking of the position of the motor. This information can be used to create complex motion patterns for massage effects. As an example, a pattern may include rotation for 180 degrees in a first direction, followed by rotation for 180 degrees in an opposite direction, based on input from the encoder 128. Embodiments provide a paddle mechanically coupled to the motor, such that as the motor operates, the paddle moves, by for example, rotating, at least one ball along an interior wall of the cavity of the housing.

In embodiments, the balls 112 and 113 have a mass ranging from 4 grams to 10 grams. In some embodiments, the balls 112 and 113 are comprised of plastic, glass, rubber, metal, or other suitable material. In some embodiments, the balls 112 and 113 may have an identical mass. In other embodiments, the balls 112 and 113 may have different masses. In some embodiments, ball 112 may be solid, while ball 113 may have a hollow center, to allow the balls 112 and 113 to have an identical size, while having different masses. The motor 124, transfer case 136 and power takeoff shaft 138 comprise a drive unit 177 that serves to provide rotational movement for balls 112 and 113. In embodiments, the drive unit 177 includes the motor 124, the paddle 132, the power takeoff shaft 138, and any intervening mechanical coupling between the motor 124 and power takeoff shaft 138. Disclosed embodiments illustrate a non-limiting example of a drive unit 177.

Figure 3:
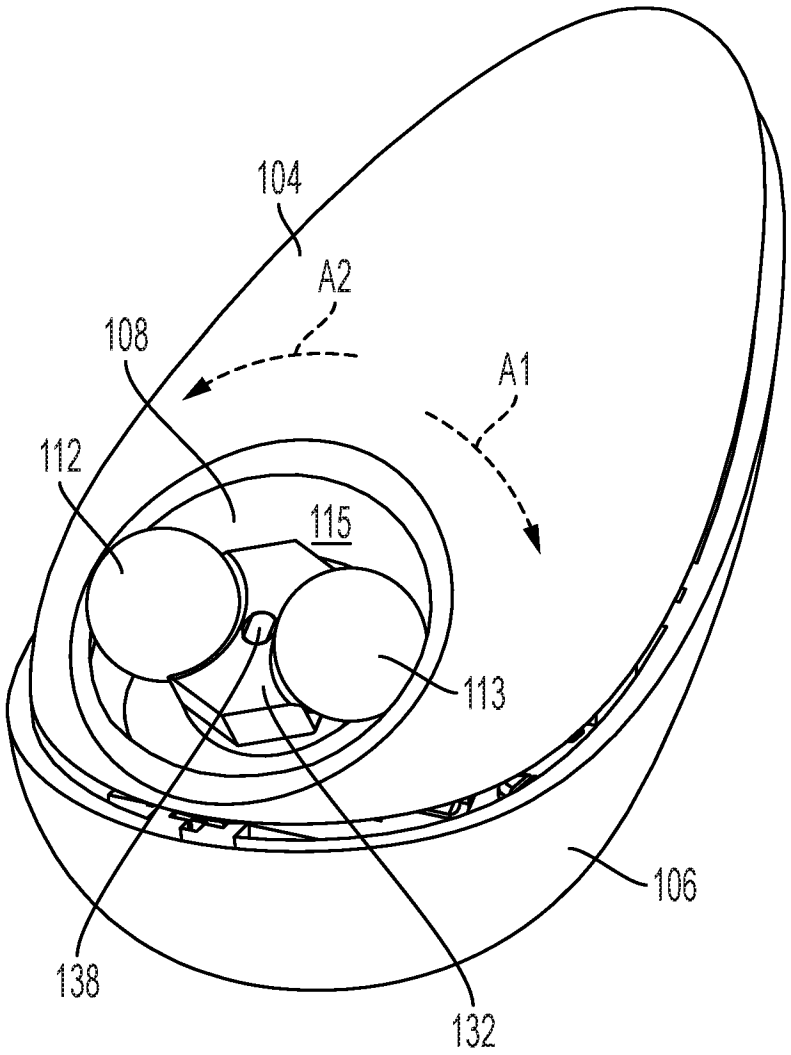
FIG. 3 is a perspective view of a massager in accordance with disclosed embodiments with the membrane removed.

FIG. 3 is a perspective view of a massager in accordance with disclosed embodiments with the membrane removed. In this view, the cavity 108 can be seen in the first housing portion 104. During operation, as the paddle 132 rotates clockwise as indicated by arrow A1 and/or counterclockwise as indicated by arrow A2, the balls 112 and 113 move along an interior wall 115 of the cavity 108 of the first housing portion 104. Thus, the ball orbits around the shaft 138. The balls 112 and 113 fit snugly within the cavity 108, but are loose enough to roll along the interior wall 115 as urged by the paddle 132. In the embodiment shown, the interior wall 115 has a concave surface to accommodate the shape of the balls.

Figure 4A:
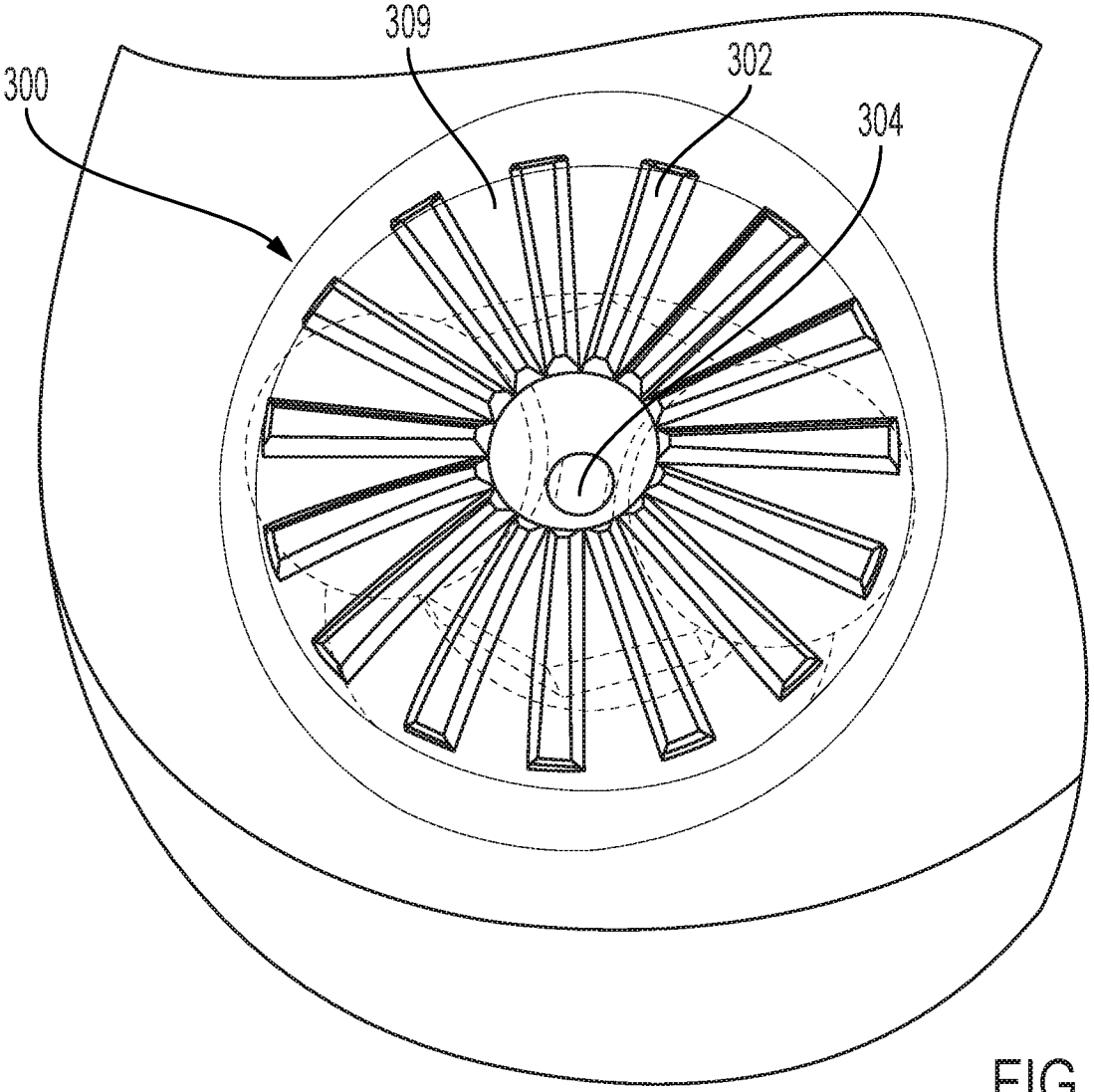
FIG. 4A is a top-down view showing details of the contact area of a massager in accordance with disclosed embodiments.
Figure 4B:
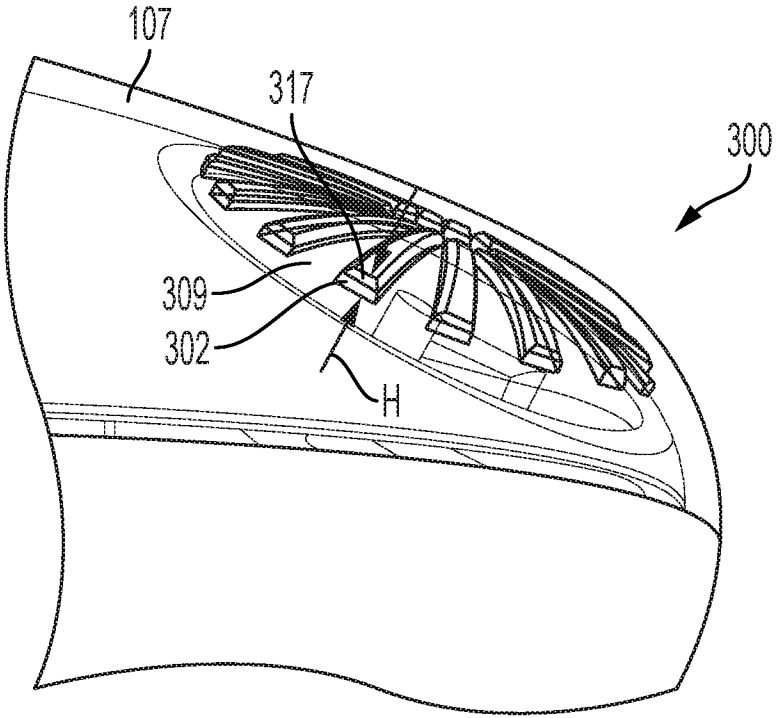
FIG. 4B is a side view showing details of the contact area of a massager in accordance with disclosed embodiments.

FIG. 4A is a top-down view showing details of an example contact area 300 of a massager in accordance with disclosed embodiments. FIG. 4B is a side view showing details of the example contact area of a massager in accordance with disclosed embodiments. Referring now to FIGS. 4A and 4B, in some embodiments, a plurality of ribs, an example of which is indicated generally as 302, are arranged in a radial pattern around a center region 304. Each rib has a height H above a base surface 309 of the membrane 107. In embodiments, the ribs are formed integral to the membrane 107 via an injection mold process. In other embodiments, the ribs may be attached to the base surface 309 via an adhesive, or other suitable technique. In embodiments, the height H can range from 0.2 millimeters to 8 millimeters. In some embodiments, the height H can range from 0.8 millimeters to 1.2 millimeters. These heights are examples, and any suitable height can be substituted. In embodiments, the ribs provide additional rigidity for the portion of the membrane that covers the cavity 108. In embodiments, each rib may comprise a tapered top portion, indicated generally as 317. In embodiments, the ribs can also provide a textured feel for the user, which can enhance the user experience. When the ribs are pressed against the skin of a user, the ribs concentrate pressure into a reduced surface area as compared with a smooth surface, which for some users, can create an increased pleasurable sensation. Embodiments with the tapered top portion provide a further reduction in surface area of the rib that contacts the skin, for increased pressure. Some embodiments may not use any ribs, and instead utilize a smooth membrane surface, or another texture, for the intended massage surface.

In embodiments, the membrane further comprises a contact area disposed on the membrane over the cavity, wherein the contact area comprises a center region, and a plurality of raised ribs arranged in a radial pattern around a center region. In some embodiments, each rib of the plurality of raised ribs has a height between 2 millimeters and 8 millimeters. In some embodiments, the plurality of ribs comprises between 12 and 20 ribs. In some embodiments, there may be more than 20 ribs. In some embodiments, there may be fewer than 12 ribs. In some embodiments, instead of the pattern being radial as shown in FIGS. 4A-4B, other patterns can be substituted, including, but not limited to, a grid, a weave, and/or other patterns and/or combinations of patterns.

Figure 5A:
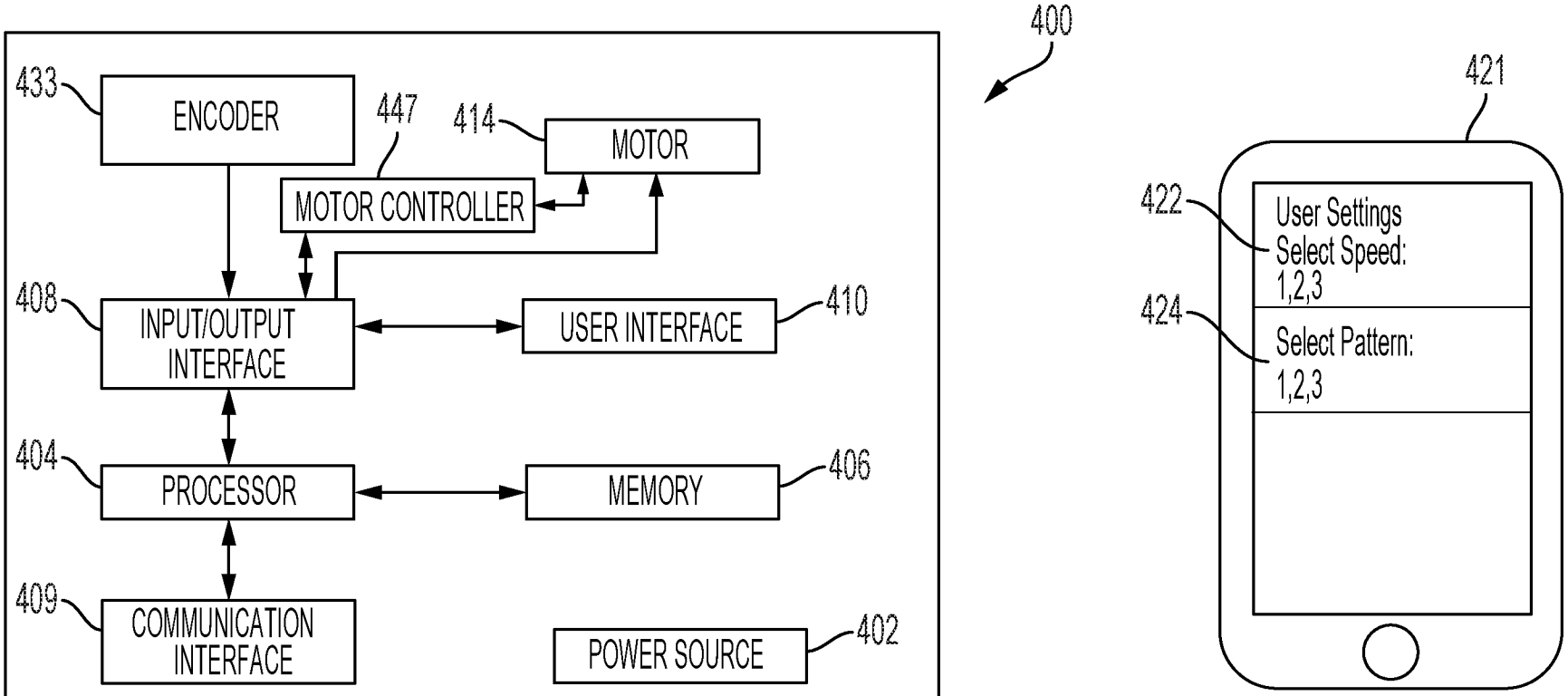
FIG. 5A is a block diagram showing components of disclosed embodiments.

FIG. 5A is a block diagram showing components of an embodiment of the present invention. Embodiment 400 includes a processor 404 and a memory 406 coupled to the processor 404, an input/output (I/O) interface 408 coupled to the processor 404, and a user interface 410 coupled to the I/O interface 408.

A power source 402 powers the processor 404, motor 414, and other electronic components. Power source 402 may be a battery, which may be a replaceable, or internally sealed rechargeable battery. In some embodiments, the battery may be USB-chargeable, inductively chargeable, or other suitable charging mechanism now known or hereafter developed. It should be recognized that any power source, now known or hereafter developed, may be used. More than one battery may be included in some embodiments. In some embodiments, the stimulation device may be powered by alternating current power, such as 120V or 240V standard household power, with a power adapter comprising voltage regulators to convert the power to an appropriate DC level (e.g. 12V DC).

The memory 406 may include a non-transitory computer readable medium including, but not limited to, flash, EEPROM, static ram (SRAM), or other suitable storage type. The memory 406 contains instructions, that when executed by processor 404, enable embodiments of the present invention. The user interface 410 may comprise one or more buttons, lights, buzzers, liquid crystal displays, and/or other suitable components for control and operation of the device.

The massager further includes motor 414. The direction of movement of motor 414 may be controlled via a signal from input/output interface 408. In embodiments, motor controller 447 receives signals from the input/output interface 408. These can include signals indicative of desired operating speed, battery voltage level, and/or motor current draw. The motor controller 447 includes components to operate a closed loop feedback system for control of the motor 414, to provide a consistent user experience in terms of motor performance during various operating conditions. The operating conditions can include battery level/life remaining, and/or the induced load on the motor cause by the amount of force the user uses when pressing the device against their body. In embodiments, the motor controller 447 may communicate with the processor 404 through a communication bus, serial interface, or other suitable technique as is known in the art.

The device may further include a communication interface 409, which may support a wired and/or wireless communication protocol, including, but not limited to, Wi-Fi, Bluetooth, infrared, or other suitable communication protocol. The communication interface 409 can enable communication with a remote device 421 such as a smartphone or tablet computer to enable additional user interface functions on the remote device. In some embodiments, the massager may be controllable via an application on the remote device 421, instead of, or in addition to user interface 410. Accordingly, in some embodiments, the user interface 410 may not be present. In some embodiments, a user interface rendered on remote device 421 may include additional options. In embodiments, the additional options include a speed setting 422. The speed setting may have various available levels (e.g. level 1, 2, and 3). Each level may correspond to a different operational speed of motor 414. In some embodiments, no pattern is used, and the device may operate at a constant speed and direction of rotation. In embodiments, the additional options include a pattern setting 424. The pattern setting may have various available preset patterns (e.g. option 1, 2, and 3). Each pattern may correspond to a different massage pattern created by motor 414. Optionally, an encoder 433 may be used to track precise position and motion of the shaft of motor 414 and/or coupled mechanisms. The patterns can include direction of rotation, speed of rotation, height variation of the ball(s), and/or other parameters.

In some embodiments, the remote device may accept voice commands as input. In such embodiments, the user can utter a phrase to control operation of the embodiment 400. As an example, a user can utter a phrase such as "faster" or "slower" to control the speed setting as an alternative to physically touching the remove device.

Figure 5B:
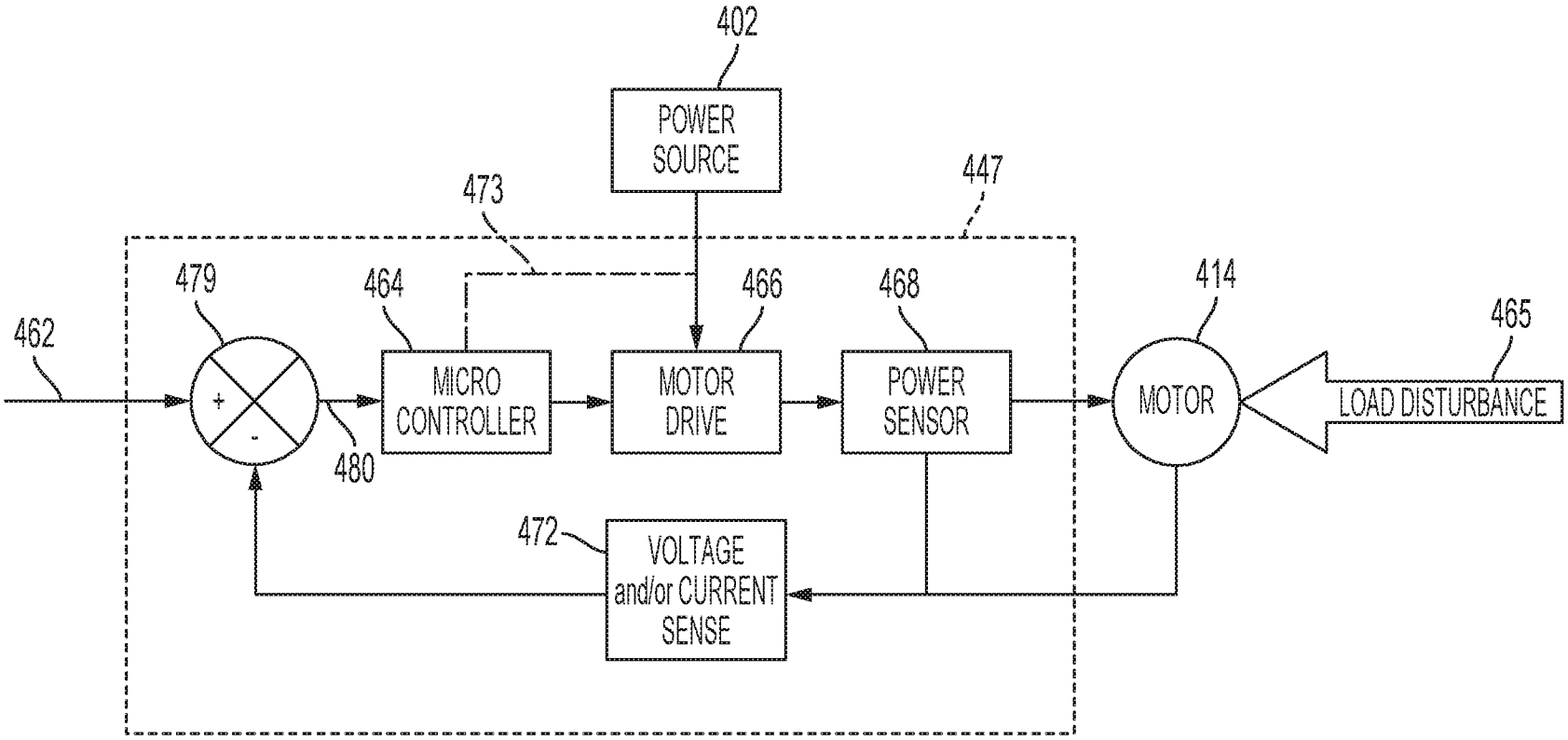
FIG. 5B is a diagram showing details of the motor controller.

FIG. 5B shows details of a motor controller 447 in accordance with embodiments of the present invention. The motor controller 447 includes a microcontroller 464. The microcontroller 464 is coupled to a motor drive module 466 which contains additional circuitry for creating voltages suited to operation of motor 414. A power sensor 468 detects the amount of powering being drawn by the motor 414. A closed loop control is accomplished by having a feedback path from the motor to voltage and/or current sense module 472, to comparator 479. Comparator 479 also is configured to receive a user set point signal 462. The user set point signal 462 is indicative of a request speed of operation of the device. The microcontroller 464 receives a signal 480 based on the user set point signal and the voltage and/or current sense module 472. Additionally, a signal 473 representative of the energy level of the power source 402, such as batteries, that power the motor 414 is also input to the microcontroller 464. The microcontroller 464 then performs computations to generate a corresponding output from the motor drive 466 to control the motor 414 at the desired speed. As the user presses a device against his/her skin, an increase in motor load (indicated by arrow 465) occurs. The motor controller 447 serves to maintain a consistent operational speed of motor 414 during use, taking in to account the changing conditions of battery life, and the pressure the user applies on the motor during use. This provides an enhanced user experience by maintaining a desired speed, and hence, provides the type of massage the user wants.

Figure 6:
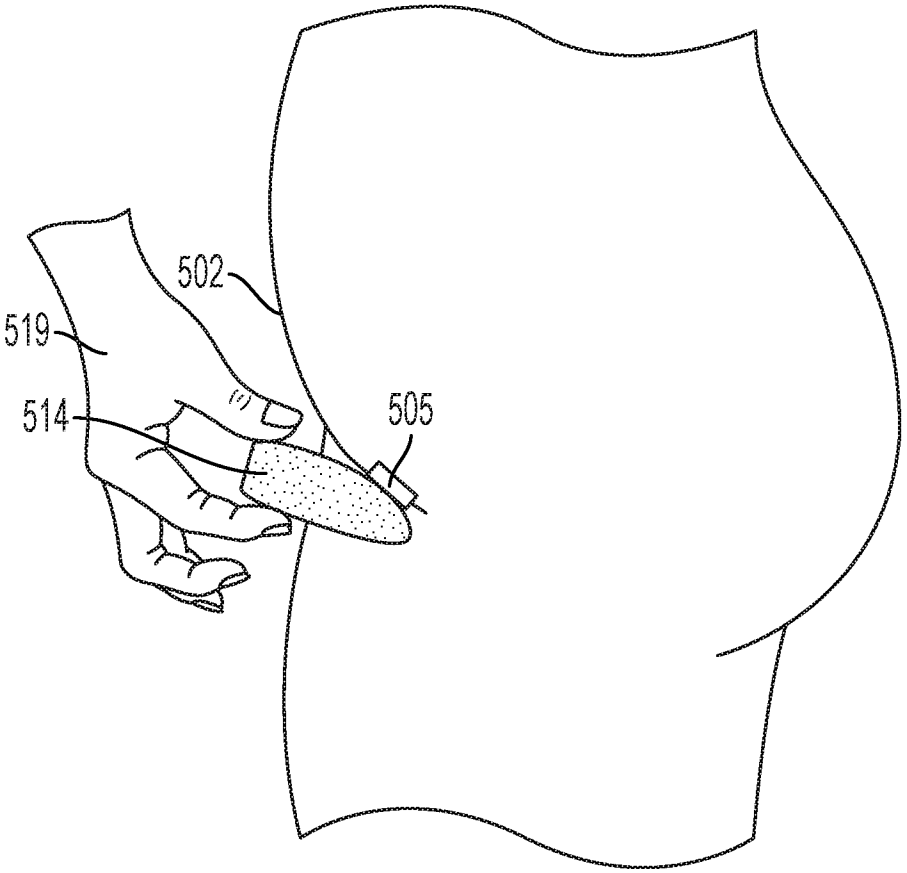
FIG. 6 shows an example usage of disclosed embodiments.

FIG. 6 shows an example usage of disclosed embodiments. A user 502 can place a massager 514 in accordance with disclosed embodiments against a portion of their body, such as clitoris 505 (indicated by the rectangle shape for the purposes of this disclosure). The massager 514 may be operated such that it is in direct physical contact with the clitoris represented at 505 in FIG. 6. Additionally, the massager 514 may be operated such that garments such as underwear and/or pants are disposed between the clitoris 505 and the massager 514. In embodiments, the device 514 is a handheld device, and may be held in place by the hand 519 of a user or their partner. In some embodiments, the device 514 may be held in place by a belt or other supporting object, such that it can be operated in a hands-free mode. It should be recognized that the clitoris is an example use case, and any area of the body may be massaged with embodiments, such as the leg, arms, or face.

Figure 7B:
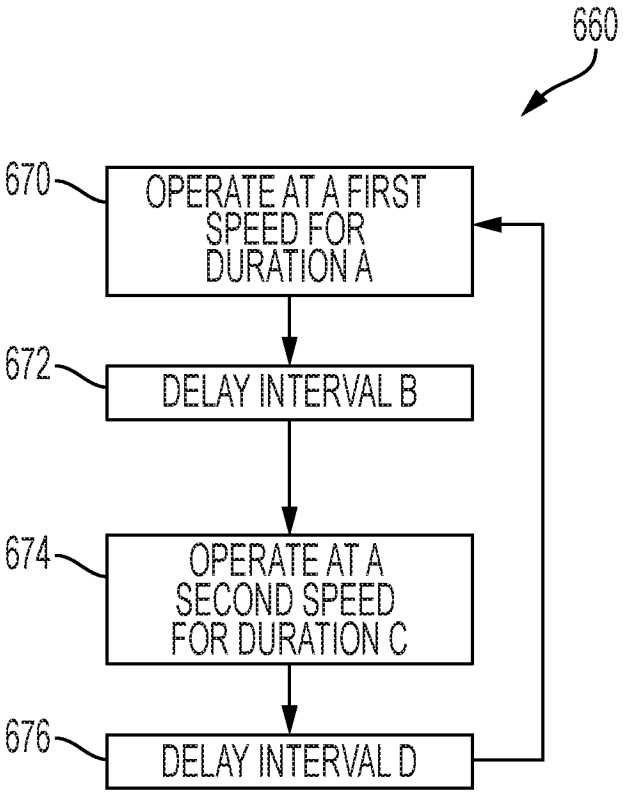
FIG. 7B is a flowchart for additional disclosed embodiments.
Figure 7A:
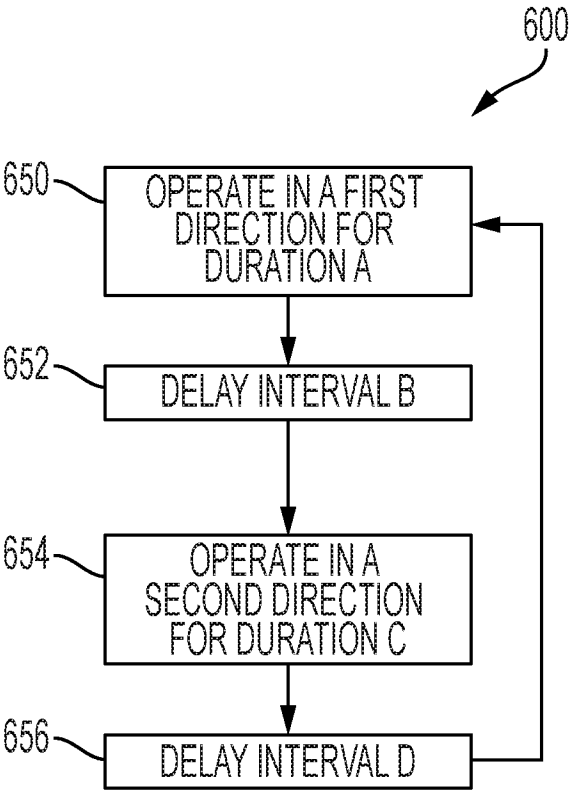
FIG. 7A is a flowchart for disclosed embodiments.

FIG. 7A is a flowchart 600 for disclosed embodiments. At 650, the device operates in a first direction (e.g. clockwise) for a duration A. In embodiments, the duration A can range from 1 second to 5 seconds. At 652, the device pauses for a duration B. In embodiments, the duration B can range from 100 milliseconds to 800 milliseconds. At 654, the device operates in a second direction (e.g. counterclockwise) for a duration C. In embodiments, the duration C can range from 1 second to 5 seconds. At 656, the device pauses for a duration D. In embodiments, the duration D can range from 100 milliseconds to 800 milliseconds.

In embodiments, a memory contains instructions, that when executed by a processor, cause the motor to perform an operation sequence, wherein the operation sequence comprises rotating in a first direction for a first duration, followed by rotating in a second direction for a second duration.

In embodiments, the memory further contains instructions, that when executed by the processor, cause the motor to pause for a third duration after the rotating in the first direction and before the rotating in the second direction. In embodiments, the memory further contains instructions, that when executed by the processor, cause the motor to pause for a fourth duration after the rotating in the second direction.

FIG. 7B is a flowchart 660 for disclosed embodiments. At 670, the device operates at a first speed for a duration A. In embodiments, the duration A can range from 1 second to 5 seconds. At 672, the device pauses for a duration B. In embodiments, the duration B can range from 100 milliseconds to 800 milliseconds. At 674, the device operates at a second speed for a duration C. In embodiments, the duration C can range from 1 second to 5 seconds. At 676, the device pauses for a duration D. In embodiments, the duration D can range from 100 milliseconds to 800 milliseconds. In some embodiments, the first speed is in the range from 1 revolution per second (rps) to 4 rps, and the second speed is in the range of 5 rps to 10 rps. Other speed ranges are possible in disclosed embodiments.

In embodiments, the memory contains instructions, that when executed by the processor, cause the motor to perform an operation sequence, wherein the operation sequence comprises rotating at a first speed for a first duration, followed by rotating at a second speed for a second duration. In embodiments, the memory further contains instructions, that when executed by the processor, cause the motor to pause for a third duration after the rotating at the first speed and before the rotating at the second speed.

Figure 8:
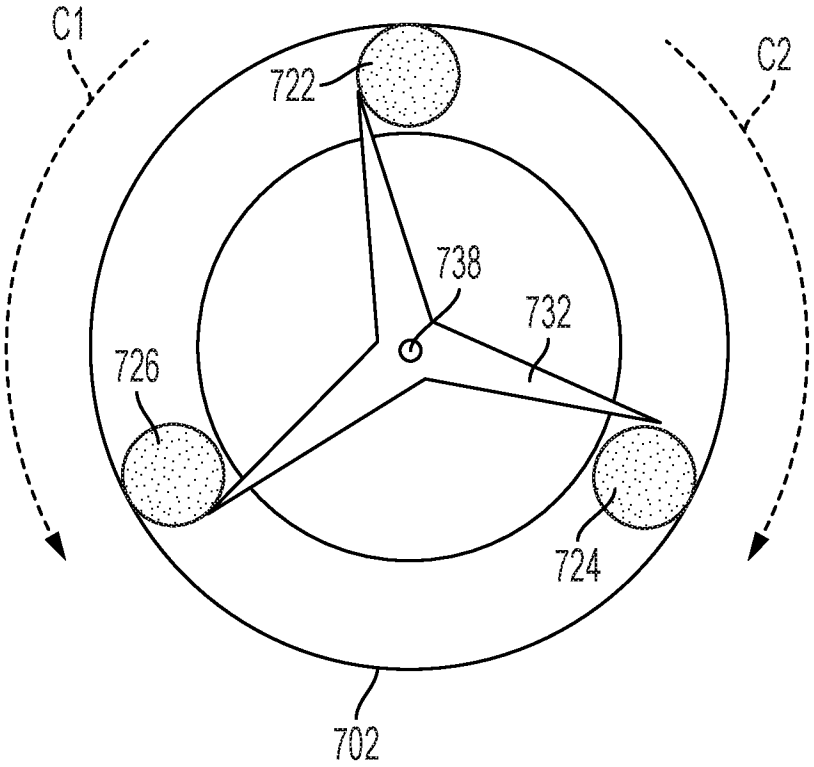
FIG. 8 shows a circular track with three balls in accordance with disclosed embodiments.

FIG. 8 shows an embodiment of the invention including a circular track 702 with three balls, indicated as 722, 724, and 726. Paddle 732 is in contact with each of the balls. Paddle 732 is affixed to, and rotates about, shaft 738. The paddle 732 may rotate in the directions indicated by arrows C1 and C2. In some modes of operation, the paddle 732 may alternate between the directions indicated by arrows C1 and C2, and in some embodiments, may pause for a predetermined duration before changing directions. Note that while the embodiment of FIG. 8 shows three balls, other embodiments can have more or fewer balls. In embodiments, the at least one ball is configured and disposed to move in a circular track. In embodiments, the at least one ball comprises three balls.

Figure 9A:
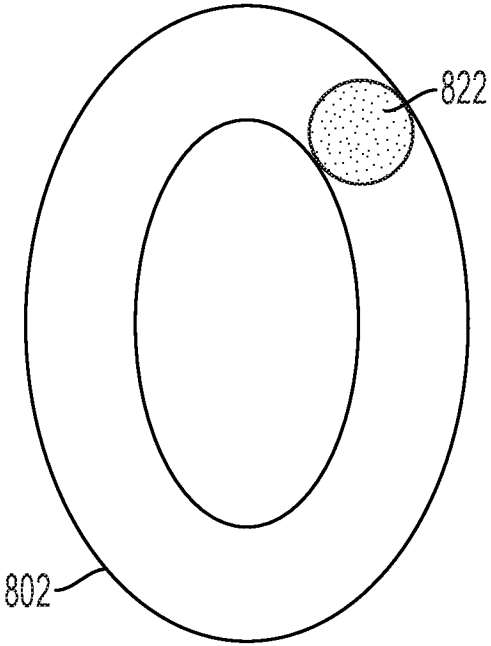
FIG. 9 shows an ovular track with one ball in accordance with disclosed embodiments.

FIG. 9A shows an oval-shaped track 802 with one ball 822 in accordance with disclosed embodiments. Note that while the embodiment of FIG. 9A shows one ball, other embodiments can have more balls within an oval-shaped track. In embodiments, the at least one ball is configured and disposed to move in an oval-shaped path.

Figure 9B:
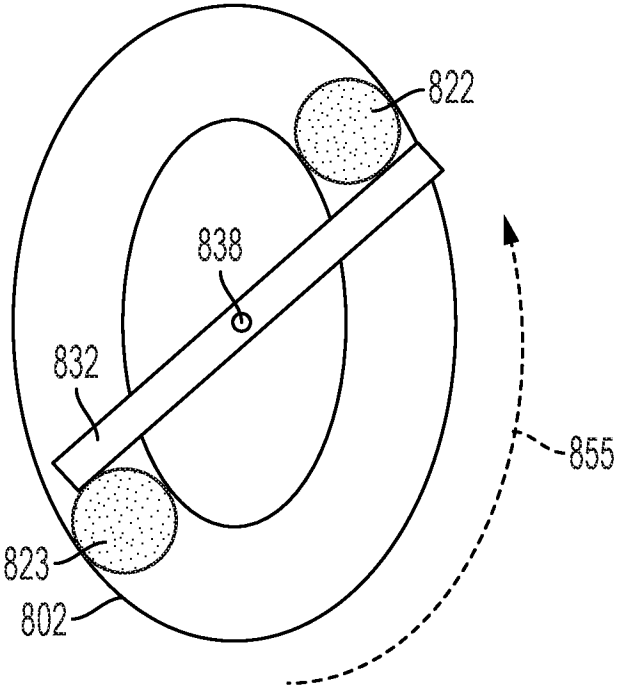

FIG. 9B shows oval-shaped track 802 with two balls 822 and 823, and also shows the additional detail of a paddle 832 coupled to shaft 838. As shaft 838 rotates, the balls 822 and 823 are moved around the track 802 in the direction indicated by arrow 855.

Figure 10:
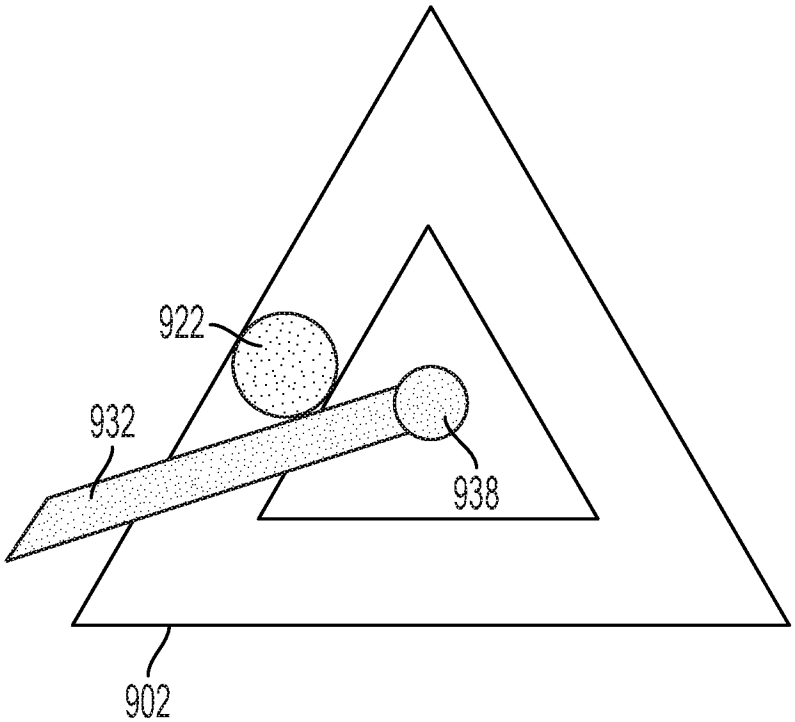
FIG. 10 shows a triangular track with one ball in accordance with disclosed embodiments.

FIG. 10 shows a triangular track (cavity) 902 with one ball 922 in accordance with disclosed embodiments. Track 902 comprises a triangular path. Note that while the embodiment of FIG. 10 shows one ball, other embodiments can have more balls within a triangular track. In embodiments, the at least one ball is configured and disposed to move in a triangular path. Paddle 932 is affixed to, and rotates about, shaft 938, to move the at least one ball around the track 902.

Figure 11:
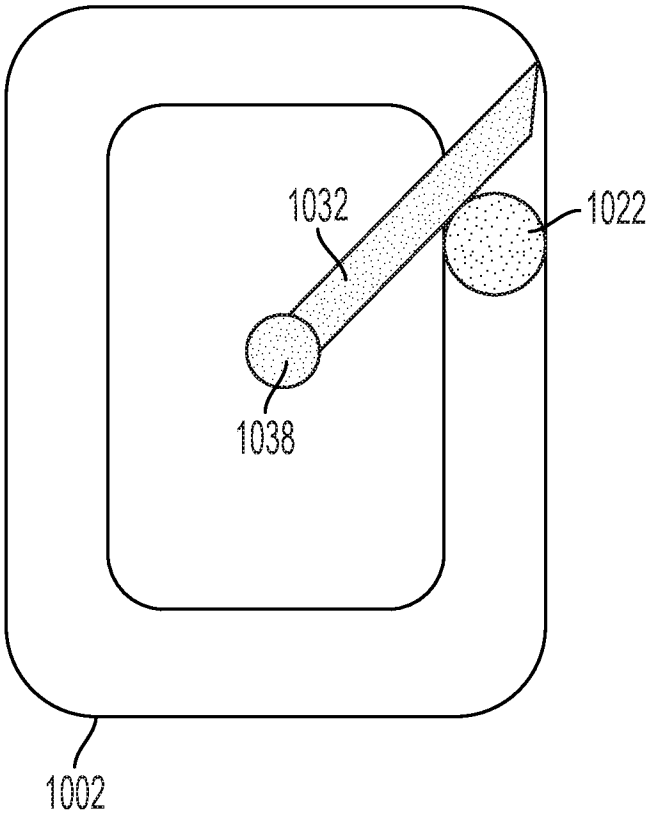
FIG. 11 shows a rectangular track with one ball in accordance with disclosed embodiments.

FIG. 11 shows a rectangular track (cavity) 1002 with one ball 1022 in accordance with disclosed embodiments. Track 1002 comprises a rectangular path. Note that while the embodiment of FIG. 11 shows one ball, other embodiments can have more balls within a rectangular track. Paddle 1032 is affixed to, and rotates about, shaft 1038, to move the at least one ball around the track 1002.

Figure 12:
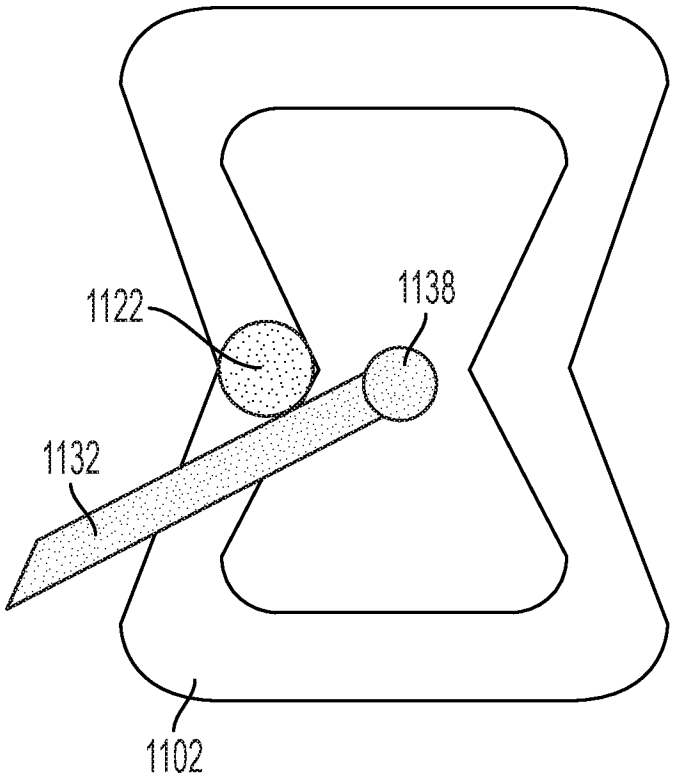
FIG. 12 shows an hourglass track with one ball in accordance with disclosed embodiments.

FIG. 12 shows an hourglass-shaped track (cavity) 1102 with one ball 1122 in accordance with disclosed embodiments. Track 1202 comprises an hourglass-shaped path. Note that while the embodiment of FIG. 12 shows one ball, other embodiments can have more balls within an hourglass-shaped track. In embodiments, the at least one ball is configured and disposed to move in an hourglass path. Paddle 1132 is affixed to, and rotates about, shaft 1138, to move the at least one ball around the track 1102.

13A shows a side cutaway view of details of an additional embodiment. FIG. 13B shows a top-down view of FIG. 13A. In this embodiment, paddles 1341 and 1343 are affixed to a carrier 1339. The carrier 1339 has an outer rim 1375 that serves to constrain the balls 112 and 113. The carrier 1339 is coupled to motor 1330 via shaft 1337. As the motor 1330 operates, the shaft 1337 rotates, which rotates carrier 1339, thereby causing the balls 112 and 113 to rotate within housing 1340.

FIG. 14A-FIG. 14C show details of an additional embodiment utilizing shims along the track. Motor 1424 is mechanically coupled to shaft 1426 such that when the motor 1424 operates, the shaft 1426 rotates as indicated by arrow S1 or S2, thereby turning paddle 1428 such that it moves ball 1412 around the track 1402. FIG. 14C is a side view of a shim in the track. As the ball 1412 travels along base level 1437 of the track 1402, and then travels over shims 1432 and 1434 along the path indicated by arrow 1441, it elevates, as indicated in FIG. 14C. This creates additional intermittent pressure against the user when the massager is held against the clitoris, or other area of the body.

FIG. 15 is a graph 1500 showing the relationship of the height of the top 1439 of the ball 1412 above the base level 1437 of the track 1402 of FIGS. 14A-14C. Vertical axis 1502 represents a height of the ball above a base level of the track. Horizontal axis 1504 represents a position, in angular degrees, of the ball within the track. In this embodiment, the ball has a default height H1 of the top 1439 of the ball 1412 above the base level 1437 of the track 1402. As the ball 1412 travels over the shims 1432 and 1434, it achieves a maximum height H2 of the top 1439 of the ball 1412 above the base level 1437 of the track 1402. In some embodiments, height H1 ranges from 5 millimeters to 15 millimeters. In some embodiments, height H2 ranges from 20 millimeters to 35 millimeters. Based on the shim placement as shown in FIG. 14B, the graph 1500 has a curve 1506 that indicates a peak at 90 degrees and 270 degrees. While FIG. 14B shows two shims 1432 and 1434 in the track 1402, in practice there can be more or fewer shims. Furthermore, the shims can be placed at different positions within the track 1402. The number and placement of shims within the track affects the number and position of the peaks on the graph such as illustrated in FIG. 15.

FIG. 16A and FIG. 16B show an additional embodiment utilizing a split carrier. In this embodiment, a carrier is comprised of a first section 1642 and a second section 1644. Each section is configured and disposed to move independently of each other with a suspension element (spring). In embodiments, the suspension element includes a spring. Section 1642 is coupled to suspension element 1656 which is affixed to a spar 1652. The spar 1652 is affixed to the interior of the housing (not shown in this FIG. for clarity, but similar to the housing of FIG. 1). Section 1644 is coupled to suspension element 1658 which is affixed to a spar 1654. As the balls 1612 and 1613 rotate with respect to the section 1644, the fluctuation in weight over the springs 1656 and 1658 cause the section to move as indicated by 1642A. This motion can cause a pleasurable sensation for a user. The spar 1654 is affixed to the interior of the housing. A motor 1624 is mechanically coupled to shaft 1671. Shaft 1671 is coupled to paddle 1632, such that when the motor 1624 rotates, the shaft 1671 rotates, causing the paddle 1632 to rotate, thereby moving balls 1612 and 1613 over the first section 1642 and the second section 1644 during operation.

In embodiments, the balls 1612 and 1613 have a mass ranging from 4 grams to 10 grams. In some embodiments, the balls 1612 and 1613 are comprised of plastic, glass, metal, or other suitable material. In some embodiments, the balls 1612 and 1613 may have an identical mass. In other embodiments, the balls 1612 and 1613 may have different masses. In some embodiments, ball 1612 may be solid, while ball 1613 may have a hollow center, to allow the balls 1612 and 1613 to have an identical size, while having different masses.

As the paddle 1632 rotates, the balls are moved onto the sections 1642 and 1644 having suspension elements. This causes the sections to deflect based on the spring constant of the suspension elements. In some embodiments, suspension element 1656 and suspension element 1658 are springs having an identical spring constant. In embodiments, the spring constant of the suspension elements 1656 and 1658 may range from 0.3 N/mm to 0.5 N/mm. Other spring constant values are possible in some embodiments. In some embodiments, suspension element 1656 and suspension element 1658 are springs having different spring constants. The spring constants and masses of the balls may be selected to create a particular pattern, which can induce a pleasurable sensation in a user.

As can now be appreciated, a device in accordance with disclosed embodiments can provide a combination of sensations that provide a clitoral massager that creates a sensation of manual manipulation by human fingers or tongue, generating a unique and pleasurable sensation for the user.

While the invention has been particularly shown and described in conjunction with exemplary embodiments, it will be appreciated that variations and modifications will occur to those skilled in the art. The embodiments according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A massager, comprising:

a housing having a cavity therein;

a motor disposed within the housing;

a membrane disposed over at least a portion of the housing, including the cavity; and a paddle mechanically coupled to the motor, wherein the paddle is configured to move a first ball along an interior wall of the cavity of the housing, wherein the paddle comprises a first concave surface, and wherein the interior wall is a concave shape, and wherein the first concave surface extends only partially laterally around the first ball; and the first ball disposed between the first concave surface and the interior wall of the cavity of the housing; and wherein the first ball is disposed to roll along the concave shape of the interior wall during operation of the massager.

2. The massager of claim 1, further comprising a second ball, and wherein the paddle comprises a second concave surface;

wherein the second ball is disposed between the second concave surface of the paddle and the interior wall of the cavity of the housing; and wherein the second ball is disposed to roll along the concave shape of the interior wall during operation of the massager.

3. The massager of claim 1, wherein the membrane is comprised of silicone.

4. The massager of claim 1, wherein the membrane further comprises a contact area disposed on the membrane over the cavity, wherein the contact area comprises a center region, and a plurality of raised ribs arranged in a radial pattern around a center region.

5. The massager of claim 1, wherein the first ball protrudes out from the interior wall of the cavity against the membrane.

6. The massager of claim 1, wherein the cavity comprises a track.

7. The massager of claim 6, wherein the track includes at least one shim thereon, wherein the at least one shim comprises an area of greater height relative to a base level of the track.

8. The massager of claim 1, wherein the cavity comprises a circular path.

9. The massager of claim 1, wherein the cavity comprises an oval-shaped path, a triangular path, or an hourglass-shaped track.

10. The massager of claim 1, wherein the paddle is configured to move by rotation.

11. A massager, comprising:

a housing having an interior wall that outlines a cavity therein, wherein the interior wall is a concave shape;

a drive unit disposed within the housing, wherein the drive unit comprises:

a motor, and a paddle disposed in the cavity, wherein the paddle has a first concave surface;

a first ball disposed between the first concave surface of the paddle and the concave shape of the interior wall in such a way that the first ball may roll around between the first concave surface of the paddle and the interior wall during operation of the massager, and wherein the first concave surface extends only partially laterally around the first ball;

a membrane disposed over at least a portion of the housing, including the cavity;

a processor; and a memory, wherein the memory contains instructions, that when executed by the processor, causes the drive unit to move the paddle.

12. The massager of claim 11, wherein the first ball protrudes out from the interior wall of the cavity against the membrane.

13. The massager of claim 11, wherein the cavity comprises a track.

14. The massager of claim 13, wherein the track includes at least one shim thereon, wherein the at least one shim comprises an area of greater height relative to a base level of the track.

15. The massager of claim 11, wherein the track comprises a circular path, an oval-shaped path, a triangular path, or an hourglass-shaped path.

16. The massager of claim 15, wherein the first ball protrudes out from a cavity wall against the membrane.

17. The massager of claim 13, wherein the track includes at least one shim thereon.

18. The massager of claim 11, further comprising a second ball;

wherein the paddle comprises a second concave surface; and wherein the second ball is disposed between the second concave surface of the paddle and the concave shape of the interior wall of the cavity of the housing in such a way that the second ball may roll around between the second concave surface of the paddle and the concave surface of the interior wall during operation of the massager.

19. A massager, comprising:

a housing having an interior wall that outlines a cavity therein, wherein the interior wall is a concave shape;

a drive unit disposed within the housing, wherein the drive unit comprises:

a motor, and a paddle disposed in the cavity, wherein the paddle has a first concave surface;

a first ball disposed movably between the first concave surface of the paddle and the interior wall, and wherein the first concave surface extends only partially laterally around the first ball; and a membrane disposed over at least a portion of the housing, including the cavity.

20. The massager of claim 19, further comprising a second ball; and wherein the paddle comprises a second concave surface; and wherein the second ball is disposed movably between the second concave surface of the paddle and the interior wall.

* * * * *